US006167957B1

(12) United States Patent
Frazier

(10) Patent No.: US 6,167,957 B1
(45) Date of Patent: Jan. 2, 2001

(54) HELICAL PERFORATING GUN

(76) Inventor: Lynn Frazier, 210 NW. 122nd St., Oklahoma City, OK (US) 73114

( * ) Notice: Under 35 U.S.C. 154(b), the term of this patent shall be extended for 0 days.

(21) Appl. No.: 09/336,385

(22) Filed: Jun. 18, 1999

(51) Int. Cl.[7] ..... E21B 29/00

(52) U.S. Cl. ..... 166/55.2; 166/241.5; 102/310; 89/1.15

(58) Field of Search ..... 166/55.1, 55.2, 166/55, 66, 241.1, 241.5, 241.6, 241.7, 277, 297; 175/2, 4.57, 4.6; 89/1.15; 102/310, 306

(56) References Cited

U.S. PATENT DOCUMENTS 4,501,327 * 2/1985 Retz ..... 166/285

5,638,901 * 6/1997 Shirley et al. ..... 166/55.1

* cited by examiner

*Primary Examiner*—David Bagnell
*Assistant Examiner*—Jennifer M Hawkins

(57) ABSTRACT

A perforating gun for use in underground wells where the gun includes a forward guiding element and a rearward conveyancing element. These two elements are interconnected by way of a series of bow springs. In the preferred embodiment, the springs are spirally configured around the central axis of the gun. The spring function in applying pressure to the internal surface of the well shaft and in centering the gun. Additionally, the springs serve in removably carrying a series of explosive charges. The spiral configuration allows perforations to be created in a 360 degree pattern around the central axis of the gun.

7 Claims, 5 Drawing Sheets

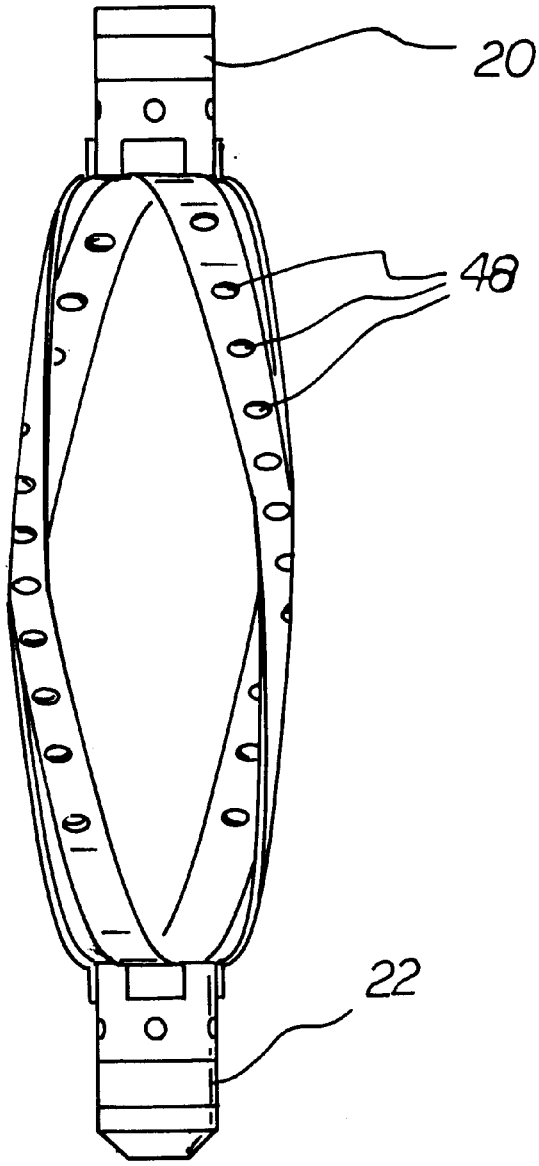
FIG 6
FIG 7
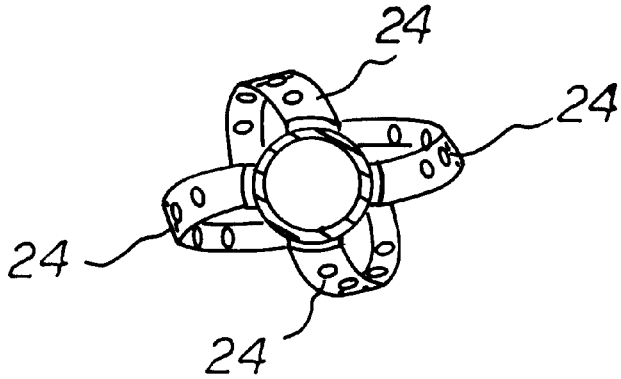

HELICAL PERFORATING GUN

BACKGROUND OF THE INVENTION

1. Field of the Invention

The present invention relates to perforating guns for use in forming underground openings, and more particularly to a means for making helical underground openings.

2. Description of Related Art

Perforating guns are commonly used in underground wells. The guns typically carry charges which perforate the well casing and surrounding earth upon detonating. The resulting perforations facilitate exploitation of mineral and hydrocarbons deposits.

One such perforating gun is described in U.S. Pat. No. 5,638,901 to Shirley et al. The gun of Shirely includes an elongated spiral strip to which a series of explosive charges are mounted.

U.S. Pat. No. 4,787,458 to Langer discloses a spring bow centralizer. The centralizer of Langer further includes reduction members for affecting the angle of contact between the bow and the adjacent well opening.

U.S. Pat. No. 5,542,480 to Owen discloses a perforating gun composed of two or more nonfrangible regions which are connected together by a frangible region.

U.S. Pat. No. 4,552,234 to Lowell discloses a perforating gun with a penetration pattern. The pattern is dispersed longitudinally along the gun and rotatively around the circumference.

U.S. Pat. No. 4,951,744 to Rytlewski discloses a gun with a charge supporting base strip of an angular cross section.

U.S. Pat. No. 4,875,413 to Christopher discloses a gun formed by a wire carriage. The wire carriage functions in supporting various charges.

One disadvantage with the majority of the aforementioned known gun designs is that none of them create a multi strand helical perforation pattern, while at the same time using the spring bow staves for containing the charges and centering the gun within the well. Such an arrangement improves the performance of the charges.

BRIEF SUMMARY OF THE INVENTION

The general purpose of the present invention is to provide a self centering perforating gun which carries charges in a straight or helical configuration.

To attain this, the present invention essentially comprises a perforating gun with a guiding element and a rearward conveyancing element. The gun further includes a number of bow springs which extend inbetween and interconnect the guiding element and conveyancing element. Each of the bow springs includes a rearward end secured to the conveyancing element and a forward end secured to the guiding element. Each of the bow springs has a plurality of threaded apertures formed through its thickness, with each successive aperture being in alignment with the adjacent aperture. A plurality of explosive encapsuated perforating charges are included on each of the springs. Each charge, or cap, has a threaded end portion which is threadably secured within one of the threaded openings of the bow spring.

It is an object of the present invention to provide a perforation gun with a series charge carrying bow springs.

It is another object of the present invention to provide a perforating gun with bow springs with either a right or left handed spiral configuration.

It is a further object of the present invention to create a well perforating device which is self centering and which carries charges in a helical configuration.

An even further object of the present invention is to provide a perforating system wherein the charges are removably interconnected to a number of bow springs.

A further object of this invention is to use several of these bow guns in tandem to perforate a limited length of hydrocarbons or minerals.

Further object of this invention to cause each charge to be contacted with the casing to cause the ideal performance from each explosive charge contained on the bow spring stave.

Lastly, it is an object of the present invention to provide a perforating gun for use in supporting and detonating explosives within a borehole for the purpose of exploiting hydrocarbons and mineral deposits. The bow gun comprises a guiding element having a lower frustro conical extent and an upper collar. A rearward conveyancing element is included which has an upper extent with a perforation formed therethrough and a lower collar. A plurality of bow springs are included which extend inbetween and interconnect the collar of the guiding element and the collar of the conveyancing element. Each of the bow springs includes a rearward end secured to the collar of the conveyancing element and a forward end secured to the collar of the guiding element. Each of the bow springs is defined by a width and a length. The width of each bow spring is twisted along its length, and each of the bow springs has a plurality of threaded apertures formed through its thickness, with each successive aperture being in alignment with the adjacent aperture. A plurality of explosive encapsulate charges are included with each explosive cap having a threaded end portion and an upper coupling means. Each of the encapsulated charges is threadably secured within one of the threaded openings of the bow springs. Detonating cords are provided with each of the detonating cords positioned along an associated bow spring. Each of the detonating cords is secured to the upper coupling means of the plurality of explosive caps. A bow spring detonation cord is included having a distal end adapted to be interconnected with a detonation means and a proximate end which is adapted to be positioned through the slot of the conveyancing element. The proximate end of the bow spring detonation cord is also interconnected to the detonating cords associated with each of the bow springs.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 6 is a side elevational view of the left handed spiral embodiment of the present invention.

FIG. 7 is a plan view of the embodiment depicted in FIG. 6.

The same reference numerals refer to the same parts throughout the various Figures.

DETAILED DESCRIPTION OF THE INVENTION

The present invention 10 relates to a perforation gun which is designed to removably support explosive charges within a borehole. The gun functions is perforating a well casing and the surrounding earth to enable a user to exploit mineral and/or hydrocarbon deposits. The gun is configured to support the charges in a pre-selected orientation until detonation is desired. In one embodiment, the body of the gun is formed from multiple springs which are oriented into a helix. The components of the present invention, and the manner in which they interrelate, will be described in greater detail hereinafter.

Figure 1:
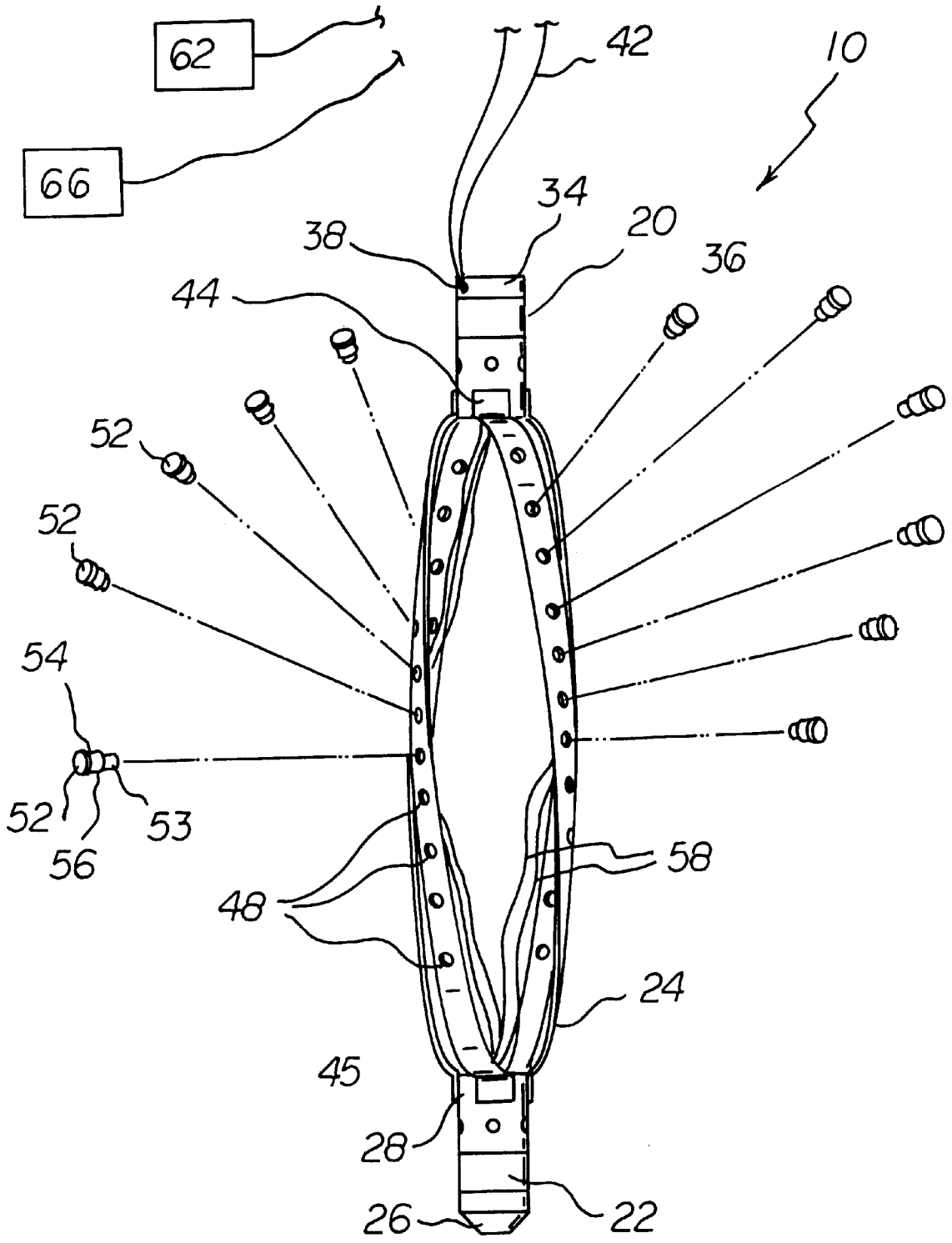
FIG. 1 is an exploded view of the perforation gun of the preferred embodiment.

Each of the gun embodiments is generally defined by a conveyancing element 20 and a guiding element 22 which are interconnected by a number of bow springs 24. The guiding element 22 is defined by a lower frustro conical extent 26 and an upper collar 28. The frustro conical extent 26 allows the gun 10 to penetrate into the interior of a borehole 30 before being detonated. The rearward conveyancing element 20 is defined by an upper extent 34 and a lower collar 36. The upper extent 34 has a perforated aperture 38 formed through its length. The function of this aperture 38 will be described in greater detail hereinafter. As illustrated in FIG. 1, the upper extent 34 is adapted to be secured to cabling, to thereby enable the gun 10 to be lowered into the into interior of the borehole 30. It is within the scope of the present invention to position multiple guns in a tandemed or end to end relationship. In this manner, a user can select the desired length to be perforated. Additionally, a detonating cord can be included with the cabling in a manner more fully described herein.

The conveyancing and guiding elements, 20 and 22, together serve to support a series of bow springs 24. In the preferred embodiment, depicted in FIG. 1, a series of bow springs 24 extend in between, and serve to interconnect, the collar 28 of the guiding element 22 and the collar 36 of the conveyancing element 20. In one embodiment, four bow springs are included. Each of the series of bow springs 24 is of an identical construction. Consequently, only one such bow spring 24 will be described in detail.

Figures 8, 9:
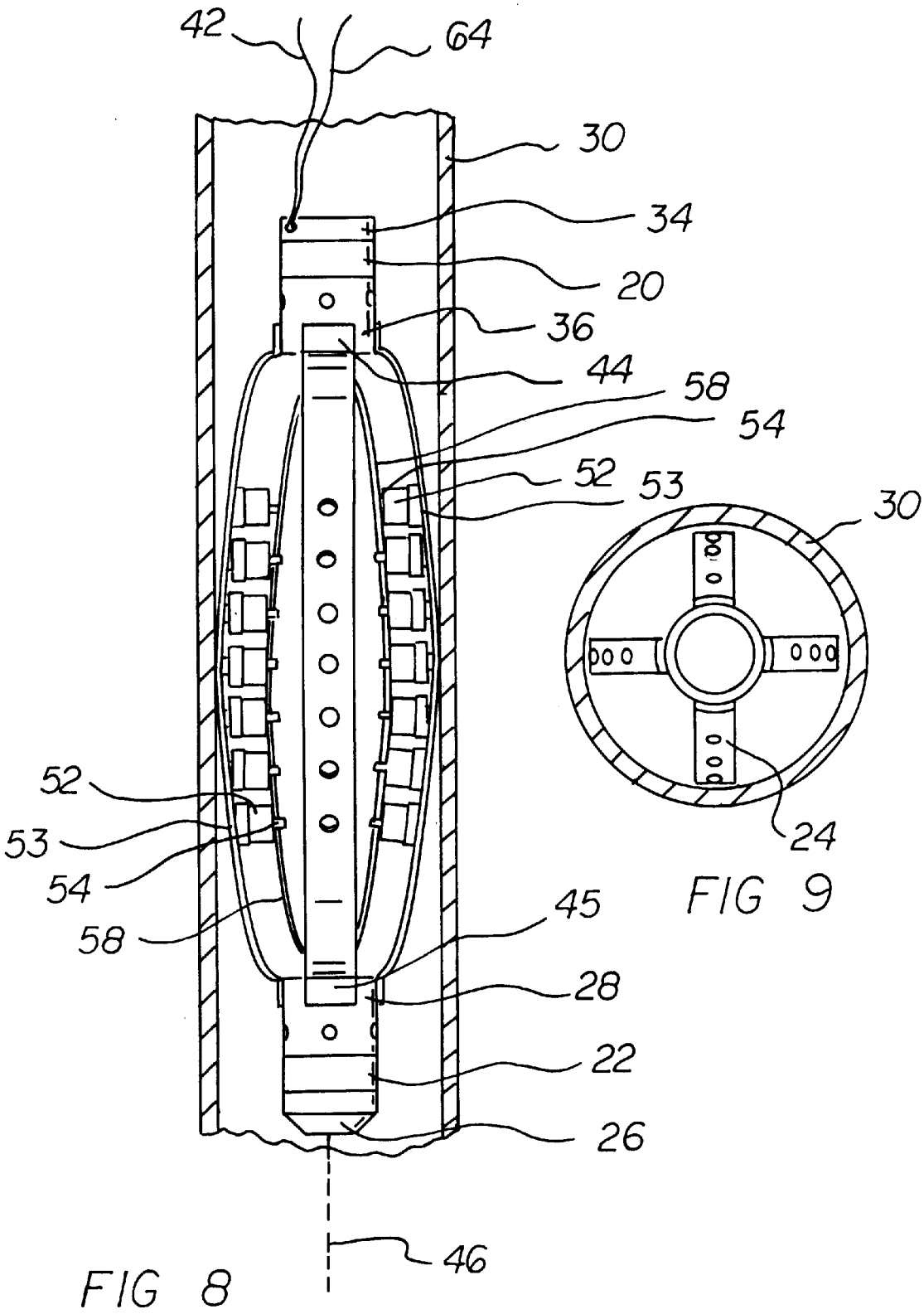
FIG. 8 is a side elevational view of the gun in position within a well.
FIG. 9 is a plan view of the embodiment depicted in FIG. 8.

The rearward end of each bow spring 24 is secured to the collar 36 of the conveyancing element 20. Preferably, the bow 24 includes a tab 44 which is welded or otherwise permanently affixed to the collar 36. In a similar fashion, the forward end of each bow spring 24 is secured to the collar 28 of the guiding element 22. This interconnection is achieved by tab 45. Each of the springs 24 is formed from a thin gauge metal and is bowed outwardly intermediate its forward and rearward ends. Furthermore, each of the bow springs 24 is defined by a width and a length. The bowed configuration gives the springs a degree of resilience. Additionally, the cross-sectional area of the straight or spiraled bow springs, or staves, is selected to prevent fragmentation upon detonation of the gun 10. The resilience, in turn, makes the body of the gun 10 flexible and affords the conveyancing and guiding elements, 20 and 22, limited movement with respect to one another. Additionally, the bowed springs 24 serve to center the gun 10 within the interior of a borehole 30. As illustrated in FIG. 8, the central axis 46 of the gun 10 is centered within the shaft of the borehole 30. Now that the general features of the gun have been described, the specific bow spring geometries employed in the various embodiments will be detailed.

Figure 2:
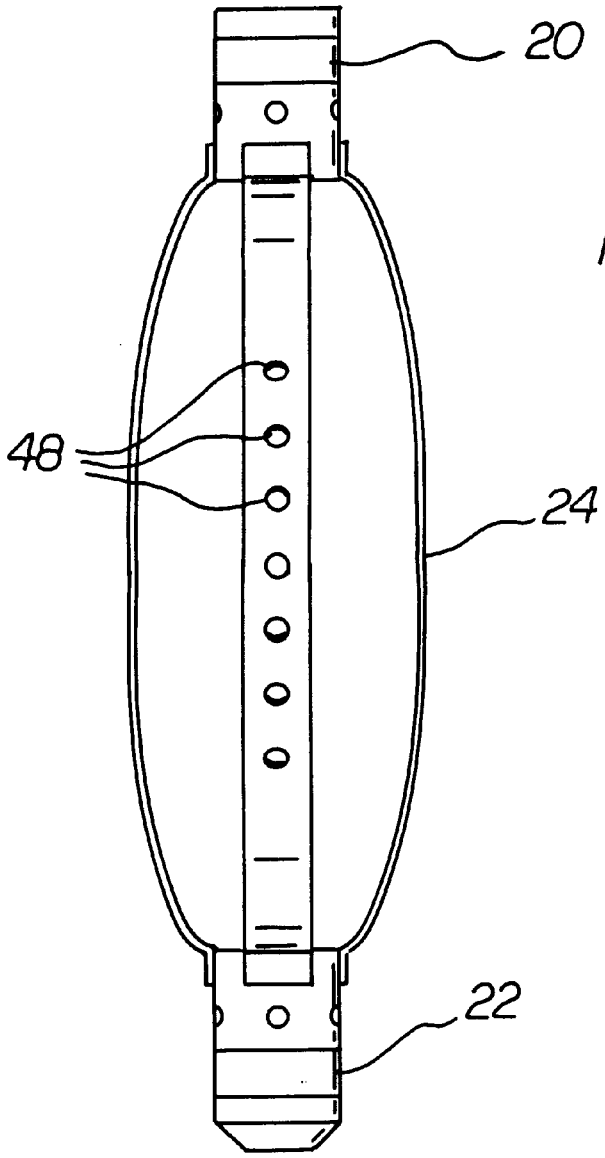
FIG. 2 is a side elevational view of an alternative embodiment of the perforating gun of the present invention.
Figure 3:
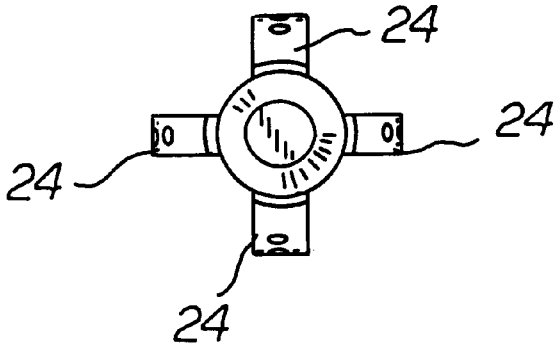
FIG. 3 is a plan view of the embodiment of FIG. 2.
Figure 4:
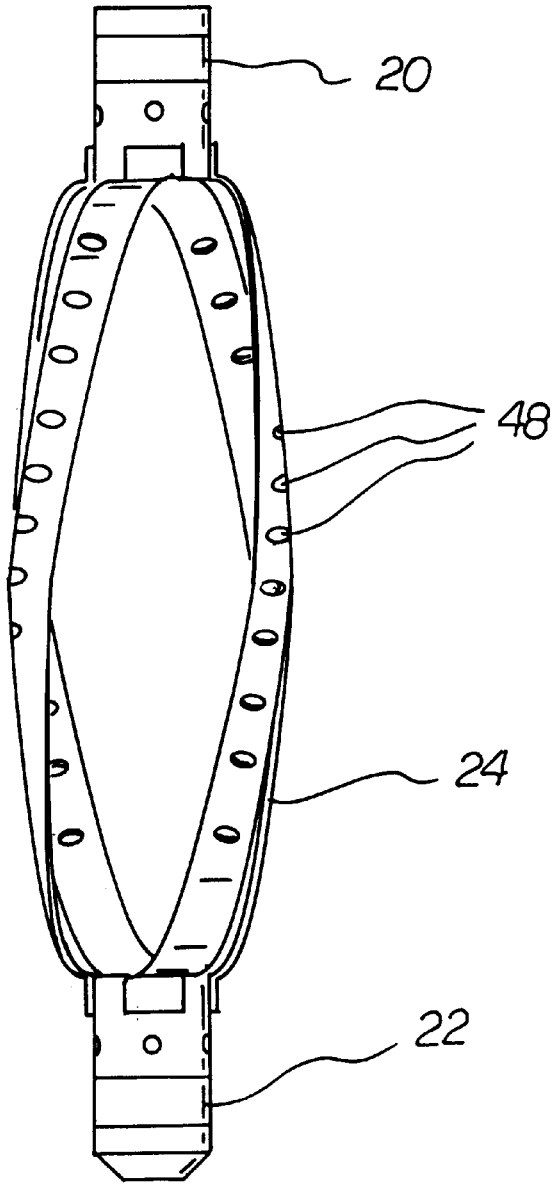
FIG. 4 is a side elevational view of the right handed spiral embodiment of the present invention.
Figure 5:
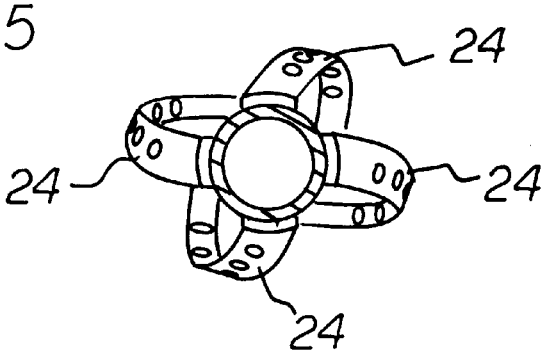
FIG. 5 is a plan view of the embodiment of FIG. 4.

The preferred bow spring geometry is that of a helix, depicted in FIGS. 1–6. FIGS. 1 and 4 depict a right handed spiral, while FIG. 6 illustrates a left handed spiral. The spiral, or phased configuration, is achieved by the twisting the width of each spring 24 along its length. The right handed spiral is achieved by twisting the springs in a clockwise orientation. Alternatively, the left handed spiral is achieved by twisting the springs 24 in an anti-clockwise orientation. The top plan views of FIGS. 5 and 7 better illustrate the differences between the right and left handed orientations of the springs. FIGS. 2 and 8 illustrate an alternative embodiment of the present invention, wherein the springs 24 are not formed in to a helix. Rather, the bows remain untwisted along their respective lengths. The function of these bow geometries will be described hereinbelow.

In all of the embodiments the springs 24 include threaded apertures 48. Specifically, each of the bow springs 24 has a plurality of apertures 48 formed through its thickness. Additionally, as illustrated in each of the Figures, the apertures 48 are in alignment with one another, with each successive aperture 48 being aligned with the adjacent aperture 48. As illustrated in FIG. 1, a plurality of explosive caps 52 are adapted to be removably interconnected to the bow springs 24 by way of the threaded apertures 48. Each of these caps 52 is defined by a threaded end portion 53 and an upper coupling means 54. The caps 52 include a cylindrical housing 56 for the storage of an explosive. Thus, as illustrated in FIG. 1, each of the caps 52 is adapted to be threadably secured within one of the threaded openings 48 of the bow springs 24. Any number of apertures can be included on each spring. However, in the preferred embodiment 7 to 11 apertures are included on each spring.

Each of the cap 52 is further interconnected to the gun 10 by way of detonating cords 58, or prima cords. In the preferred embodiment, each such cords are included, with each cord 58 corresponding to an associated bow spring 24. Thus, each detonating cord 58 is affixed to the rear of the explosive charge adjacent to, and in series with, the associated bow spring 24, note FIG. 1. Each detonating cord 58 is secured to the upper coupling means 54 of the plurality of explosive caps 52 aligned upon the associated bow spring 24. The coupling means 54 of each cap 52 may take the form of eyelets or threading. In such an embodiment, the associated detonating cord 58 is coupled to the aligned caps 52 by being threaded through the series of eyelets or threading. All of the detonation cords 58 are, in turn, coupled together at their uppermost extents. Furthermore, a master detonation cord 42, or bow spring detonation cord, has its distal end interconnected with a detonation means 62. Additionally, the master detonation cord 42 has a proximate end which is positioned through the slot 38 of the conveyancing element 20 and interconnected to the detonating cords 58 associated with the series of bow springs 24. Thus, when the detonation command is given to the detonation means 62, which can take the form of a computerized control, electrical impulse, or mechanical means, the signal is passed from the master cord 42 to the individual detonation cords 58. In this manner, all of the explosive caps 52 are simultaneously detonated.

In use, the gun 10 is lowered into a borehole 30. Support electrical cabling 64 is employed in lowering the gun 10 and controlling its depth with the borehole 30. Such cabling is interconnected with a spool or other metering means 66 which function in supplying and retrieving the support cabling 64. The bow springs 24 serve to resiliently contact the inner surface of the borehole 30 to center the gun 10 within the borehole shaft. Once the desired position is achieved the metering means 66 ceases to supply the support cabling 64. Thereafter, the entire gun 10 can be detonated via the remote detonation device 62. The remote device 62 is interconnected to the gun 10 via an electrical cable, or major detonation cord, 42 included with the cabling. The major detonation cord 42, in turn, is interconnected to the detonation cords 58 positioned within the interior of the gun 10. Specifically, each detonation cord 58 is associated with an individual bow spring 24, and interconnected to each of the explosive cap 52 secured thereto. Thus, once the remote detonation device 62 is activated, all the explosive caps 52 are simultaneously detonated. Any remaining pieces of the gun 10 can then be retrieved from the borehole. Preferably, the bow 24 are of a strength to withstand the detonation. The detonation, however, causes perforations in the surrounding casing in a pattern which is dictated by the bow springs. Namely, spiral bow springs result in spiraled perforations. The spiral pattern is desirable in that perforations are created in a 360 degree pattern around the central axis of the gun.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by Letters Patent of the United States is as follows:

1. A perforating gun for use in supporting detonating explosives within a borehole for the purpose of exploiting petroleum and mineral deposits, the perforating gun comprising:

a guiding element having a lower frustro conical extent and an upper collar;

a rearward conveyancing element having an upper extent with a perforation formed therethrough and a lower collar;

bow springs extending in between and interconnecting the collar of the guiding element and the collar of the conveyancing element, each of the springs including;

a rearward end secured to the collar of the conveyancing element and a forward end secured to the collar of the guiding element, each of the bow springs defined by a width and a length, the width of each bow spring being twisted along its length, each of the bow springs having a plurality of threaded apertures formed through its thickness, each successive aperture being in alignment with the adjacent aperture;

a plurality of explosive caps, each explosive cap having a threaded end portion in an upper coupling means, each of the explosive caps threadably secured within one of the threaded openings of the bow springs;

detonating cords, each of the detonating cords positioned along an associated bow spring, each of the detonating cords secured to the upper coupling means of the plurality of explosive caps;

a bow spring detonation cord having a distal end adapted to be interconnected with a detonation means and a proximate end which is adapted to be positioned through the slot of the conveyancing element, the proximate end of the bow spring detonating cord also being interconnected to the detonating cords associated with the bow springs.

2. A perforating gun comprising:

a guiding element;

a rearward conveyancing element;

a number of bow springs extending in between and interconnecting the guiding element and conveyancing element, each of the bow springs including;

a rearward end secured to the conveyancing element and a forward end secured to the guiding element, each of the bow springs having a plurality of threaded apertures formed through its thickness, each successive aperture being in alignment with the adjacent aperture;

a plurality of explosive caps, each explosive cap having a threaded end portion threadably secured within one of the threaded openings of the bow spring.

3. The perforating gun as described in claim 2 wherein the number of bow springs is four.

4. The perforating gun as described in claim 3 wherein each of the bow springs is defined by a width and a length with the width of each bow spring being twisted along its length.

5. The perforating gun as described in claim 2 further comprising:

a number of detonating cords, the number corresponding to the number of bow springs, each of the detonating cords being positioned along an associated bow spring and secured to the plurality of explosive caps.

6. A perforating gun comprising:

a guiding element;

a rearward conveyancing element;

a number of bow springs extending in between and interconnecting the guiding element and conveyancing element;

each of the bow spring being twisted into a helix and adapted to have a number of explosive caps secured along its length.

7. A perforating gun comprising:

a guiding element;

a rearward conveyancing element;

a number of bow springs extending in between and interconnecting the guiding element and conveyancing element in a helical configuration, each of the bow springs including;

a plurality of explosive caps, each explosive cap being removably interconnected to an associated bow spring.

* * * * *